US005619227A

United States Patent [19]

Takebe

[11] Patent Number: 5,619,227

[45] **Date of Patent: *Apr. 8, 1997**

[54] PICTURE DATA PROCESSING DEVICE WITH PREFERENTIAL SELECTION AMONG A PLURALITY OF SOURCES

[75] Inventor: Hideharu Takebe, Hyogo-ken, Japan

[73] Assignee: Mitsubishi Denki Kabushiki Kaisha, Tokyo, Japan

[ * ] Notice: The term of this patent shall not extend beyond the expiration date of Pat. No. 5,450,097.

[21] Appl. No.: 305,621

[22] Filed: Sep. 14, 1994

Related U.S. Application Data

[63] Continuation of Ser. No. 837,688, Feb. 19, 1992, Pat. No. 5,450,097, which is a continuation of Ser. No. 530,578, May 30, 1990, abandoned.

[30] Foreign Application Priority Data

Jun. 7, 1989 [JP] Japan ..... 1-146020

[51] Int. Cl.[6] ..... G04G 5/10

[52] U.S. Cl. ..... 345/147; 345/113

[58] Field of Search ..... 340/701, 703, 340/793, 750, 791, 734, 729, 747, 730; 358/20, 183; 348/660, 671; 345/112, 113, 114, 115, 116, 119, 120, 147, 150, 186, 201

[56] References Cited

U.S. PATENT DOCUMENTS

| | | | |
|---|---|---|---|
| 3,821,730 | 6/1974 | Carey et al. | 345/195 |
| 4,924,299 | 5/1990 | Mizuno et al. | 345/116 |
| 4,977,398 | 12/1990 | Pleva et al. | 345/116 |

*Primary Examiner*—Richard Hjerpe
*Assistant Examiner*—Chanh Nguyen
*Attorney, Agent, or Firm*—Lowe, Price, Leblanc & Becker

[57] ABSTRACT

Each display control block processes color pixel data stored in a refresh memory to convert the processed data into 1-bit monochromatic picture signals. At this time, the color information possessed by the respective color pixel data are converted in a form in which the color information possessed by the color pixel data may be expressed on a monochromatic display panel. The monochromatic picture signals produced by plural display control blocks are synthesized in a display synthesizing circuit and converted into one monochromatic picture signal. At this time, the display synthesizing circuit synthesizes the signals with different degrees of display preference so that the picture surface having a lower display preference is not seen on the picture surface having a higher display preference.

17 Claims, 8 Drawing Sheets

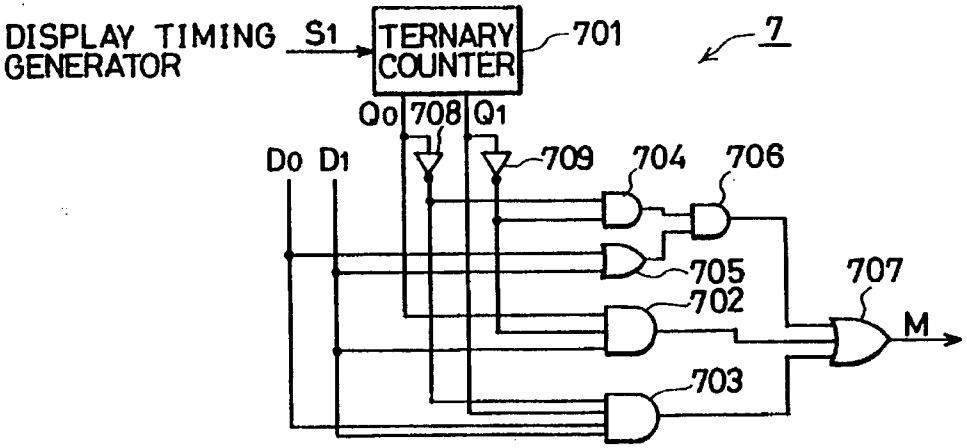
FIG. 3
PRIOR ART
FIG. 4 PRIOR ART
| PIXEL DATA | | MONOCHRO IMAGE SIGNAL M | | | |
|---|---|---|---|---|---|
| D0 | D1 | (Q1,Q0) =(0,0) | (Q1,Q0) =(0,1) | (Q1,Q0) =(1,0) | |
| 0 | 0 | 0 | 0 | 0 | |
| 0 | 1 | 1 | 0 | 0 | |
| 1 | 0 | 1 | 1 | 0 | |
| 1 | 1 | 1 | 1 | 1 | |
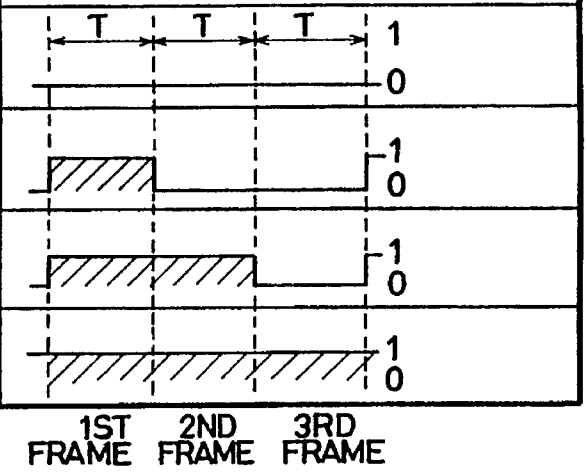

| PIXEL DATA | | MONOCHRO IMAGE SIGNAL M | | | | DISPLAY PATTERN |
|---|---|---|---|---|---|---|
| D0X | D1X | (QA,QB) =(0,0) | (QA,QB) =(1,0) | (QA,QB) =(0,1) | (QA,QB) =(1,1) | |
| | | ① | ② | ③ | ④ | |
| 0 | 0 | 0 | 0 | 0 | 0 | ① ② ③ ④ |
| 1 | 0 | 1 | 0 | 0 | 1 | |
| 0 | 1 | 1 | 0 | 1 | 0 | |
| 1 | 1 | 1 | 1 | 1 | 1 | |
| | | 1ST FRAME | 2ND FRAME | 3RD FRAME | 4TH FRAME | |

PICTURE DATA PROCESSING DEVICE WITH PREFERENTIAL SELECTION AMONG A PLURALITY OF SOURCES

This application is a continuation of application Ser. No. 07/837,688 filed Feb. 19, 1992 now U.S. Pat. No. 5,450,097, which is a continuation of application Ser. No. 07/530,578 filed May 30, 1990, now abandoned.

BACKGROUND OF THE INVENTION

1. Field of the Invention

This invention relates to a picture data processing device. More particularly, it relates to a picture data processing device in which a plurality of picture signals of m color display, where n<m, which picture signals have been obtained by converting m color display color pixel data, are synthesized to produce output synthesized signals.

2. Description of the Prior Art

Recently, in the field of thin type display panels, such as a liquid crystal display or a plasma display panel, as a result of technical innovation and cost reduction, a portable personal computer making use of such thin type display panel is becoming popular. Presently, these thin type display panels are almost uniformly of the monochromatic display type because of technical difficulties and costs.

On the other hand, in a majority of personal computers, color CRTs are inherently used as the display medium, so that the software having color display data is almost universally provided in market. However, when the software having such color display is run on a personal computer having a monochromatic display panel, problems are presented that various information contained in the color picture cannot be expressed because of marked data dropout.

For this reason, various methods have been proposed for expressing the color information in a manner different from color display on the monochromatic picture surface. The first method is to control tone gradation of each pixel on the monochromatic display surface depending on the color information possessed by the color display data. The second method is to control the display pattern on the monochromatic display surface depending on the color information possessed by the color display data. The conventional picture data processing devices for implementing these two methods are explained in more detail hereinbelow.

FIG. 1 is a block diagram showing an example of the conventional picture data processing device loaded on, for example, a personal computer, for implementing the above mentioned first method. In this figure, a number of pixel data prepared in accordance with the personal computer software are written into a refresh memory 1. When the personal computer software has the color display data, the pixel data written into the refresh memory 1 are also the pixel data containing the color information, referred to hereinafter as color pixel data. That is, each color pixel data is composed of a plurality of bits of color code data. For example, assuming the case of 2-bit color code data D0, D1, the color code data can assume four different states, such that four kinds of color expression are feasible. The refresh memory 1 is associated with the pixels on the display picture surface of the monochromatic display panel 2 and has the storage capacity of storing pixel data for at least one picture surface. Color pixel data stored in the refresh memory are read-out by an address generating circuit 3. The address generating circuit 3 is responsive to the display timing pulses supplied from the display timing generating circuit 4 to produce read addresses of the refresh memory 1 sequentially. The display timing generating circuit 4 produces display timing pulses based on synchronizing signals outputted from a synchronizing signal generating circuit 5 having a reference oscillator enclosed therein. The color picture data read-out from the refresh memory 1 are supplied to a video circuit 6. This video circuit 6 processes and re-arranges the color pixel data supplied thereto to output the color pixel data in timing with the synchronizing signals from the synchronizing signals generating circuit 5. Thus the video circuit 6 processes the color pixel data supplied thereto to output color picture signals. If the color picture signals outputted from the video circuit 6 are supplied directly to the monochromatic display panel 2, there results the above mentioned signals dropout. For this reason, a frame thinning-out circuit 7 is provided. This frame thinning-out circuit 7 converts the color picture signals supplied from the video circuit 6 into a 1-bit monochromatic picture signal M. At this time, the frame thinning-out circuit 7 controls the output of the monochromatic picture signal M in such a manner that the color information contained in the color video signal may be expressed in a form different from color display. That is, the frame thinning-out circuit 7 controls the writing duty cycle of each pixel at intervals of a predetermined number of frames, in accordance with the color information possessed by color picture signal, to convert the color information to tone gradation display. The details of the the frame thinning -out circuit 7 will be explained as the present description proceeds.

FIG. 2 is a block diagram showing another example of the conventional image data processing circuit loaded on, for example, a personal computer, for implementing the above mentioned second method. In this picture data processing device, shown in FIG. 2, a pattern generating circuit 8 is provided in place of the frame thinning-out circuit 7 in the picture data processing device shown in FIG. 1. The arrangement of the illustrative picture data processing device is otherwise the same as that of the color data processing device shown in FIG. 1. The pattern generating circuit 8 converts the color image signal supplied from the video circuit 6 into 1-bit monochromatic image signal M. At this time, the output of the monochromatic picture signal M is controlled in dependence upon the color information contained in the color picture signal for thereby converting the color information into various display patterns on the monochromatic display panel 2. That is, in this picture data processing circuit, each pixel of the color image signal corresponds to four pixels composed of 2 horizontal dots and vertical dots on the monochromatic display panel. The rectangular region composed of four pixels is sequentially display-controlled for each frame. That is, the display control of the rectangular region is to be completed by four frames with the similar display control being repeated subsequently. At this time, the pattern generating circuit 8 controls which of the pixels of the rectangular region is to be lighted in dependence upon the pixel data from the video circuit 6. The details of this pattern generating circuit 8 will also be given as the present description proceeds.

FIG. 3 is a circuit diagram showing a more detailed arrangement of the frame thinning-out circuit 7 shown in FIG. 2. Meanwhile, the frame thinning-out circuit 7 shown in FIG. 3 shows the case in which each color pixel data of the color picture signal supplied from the video circuit 6 is composed of 2-bit color code data D0 and D1. Referring to the figure, a signal S1 which rises or falls at each frame period, referred to hereinafter as the frame signal, is entered from a display timing generating circuit 4 into a ternary counter 701. This ternary counter 701 is incremented each time the frame signal S1 rises or falls and is reset to 0 in case an overflow occurs. That is, with the 0th bit and first bit output signals of the ternary counter 701 of Q0 and Q1, (Q1, Q0) is changed repeatedly at intervals of 3 frame periods in the manner of (0, 0), (0, 1), (1, 0), (0, 0), (0, 1) . . . These output signal Q1 and Q1 are transmitted to AND gates 702 and 703, respectively. The output signal Q0 is also inverted by an inverter 708 before being applied to the AND gates 703 and 704. The output signal Q1 is inverted by an inverter 709 before being applied to AND gates 702 and 704. On the other hand, the 0th order bit D0 signal of the 2-bit color picture pixel data D0 and D1 from the video circuit 6 is supplied to the AND gate 703 and an OR gate 705. The first bit signal D1 is supplied to the AND gate 702 and the OR gate 705. The outputs of the AND gate 704 and the OR gate 705 are supplied to an AND gate 706. The outputs of the AND gate 702, 703 and 706 are supplied to an OR gate 707. The monochromatic picture signal M is outputted from this OR gate 707.

FIG. 4 is an explanatory view showing changes in the waveform of the monochromatic picture signal M when the output signals Q1 and Q0 of the ternary counter 701 are changed in the manner of (0, 0), (0, 1), (1, 0), taking into account the totality of the possible combinations, that is, four combinations of the color pixel data D0 and D1. In the waveform diagram of FIG. 4, "1" indicates writing or turning on (white) and "0" indicates or turning off (black).

As shown in FIG. 4, the turn on time or the turn off time during the 3-frame (3T) differ with the difference in the color pixel data D0 and D1. That is, when the combination of the color pixel data D0 and D1 is (0, 0), (0, 1), (1, 0) or (1, 1), the turn on time (or turned off time) is 0 (3T), T (2T), 2T (T) or 3T (0), respectively, such that the writing duty ratio differs with the color information possessed by the color pixel data.

In this manner, the display brightness of each pixel on the monochromatic display panel 2 is changed in dependence on the color information of each color pixel data in the color picture signal to make possible tone gradation display on the monochromatic display surface. That is, the four kinds of color information possessed by the 2-bit color pixel data are converted into four stages of tone gradation display having different degree of brightness on the monochromatic display panel in the system of FIG. 1, such that image recognition may be feasible even on the monochromatic pixel surface as in the case of the color display.

FIG. 5 is a circuit diagram showing a more detailed arrangement of the generating circuit 8 shown in FIG. 2. Meanwhile, the pattern generating circuit 8 shown in FIG. 5 shows the case in which each color pixel data stored in the refresh memory 1 is composed of 2-bit color pixel data D0 and D1. It will be noted that the video circuit 6 converts the color pixel data read-out from the refresh memory 1 into color image signals, while converting the 1-dot color pixel data into four-dot color pixel data D0X and D1X. That is, the color pixel data D0 and D1 in FIG. 3 are switched for each dot in the horizontal direction and for each line in the vertical direction, whereas the color pixel data D0X and D1X in FIG. 5 are switched for each two-dots in the horizontal direction and for each two lines in the vertical direction. For example, a picture surface display of 640×400 dots is performed by color pixel data D0 and D1 of 320×200 dots. In FIG. 5, a signal which rises or falls at each dot or pixel, referred to hereinafter as dot signal, is entered from the display timing generating circuit 4 into the binary counter 801. This binary counter 801 outputs a 1-bit output signal QA which is switched between the high level and low level for each dot. On the other hand, a signal which rises or falls for each horizontal scanning period, referred to hereinafter as 1H signal, is entered from the display timing generating circuit 4 into the binary counter 802. This binary counter 802 outputs a 1-bit output signal QB which is switched between the high level and the low level for each horizontal scanning period. The output signal QA of the binary counter 801 is supplied to AND gates 805 and 806. This output signal QA is also inverted by an inverter 809 before being applied to AND gates 803 and 804. The output signal QB of the binary counter 802 is applied to the AND gates 804 and 806. The output signal QB is also inverted by an inverter 810 before being applied to the AND gates 803 and 805. Of the color pixel data D0X and D1X from the video circuit 6, the 0th bit signal D0 is supplied to the AND gate 806 and the OR gate 807. This bit signal D0 is also inverted by an inverter 811 before being applied to an AND gate 804. The first bit signal D1 of the color pixel data is supplied to the AND gate 805 and the OR gate 807. This bit signal D1 is also inverted by an inverter 812 before being applied to the AND gate 804. The output of the OR gate 807 is applied to the AND gate 803. The outputs of the AND gates 803 to 806 are applied to an OR gate 808. The monochromatic picture signal M is outputted from this OR gate 808.

FIG. 6 is an explanatory view showing changes in the output state of the monochromatic image signal M and the corresponding changes in the display pattern when the output signals QA and QB of the binary counters 801 and 802 are changed in the manner of (0, 0), (1, 0), (0, 1), (1, 1) in the totality of the possible combinations, that is, four combinations of the color pixel data D0X and D1X. In the image data display device of FIG. 2, as described hereinabove, the color pixel data D0X, D1X of the color image signal outputted from the video circuit 6 corresponds to a rectangular region of 2×2=4 pixels (1 to 4) on the display surface of the monochromatic display panel 2. The output signals QA and QB of the binary counters 801 and 802 are (0, 0), (1, 0), (0, 1) and (1, 1) when display controlling the pixels 1, 2, 3 and 4, respectively. Referring to FIG. 6, when the color pixel data D0X and D1X are (0, 0), the monochromatic picture signal M becomes "0" when display controlling any one of the pixels 1 to 4. Therefore, none of the pixels 1 to 4 is turned on. When the color pixel data D0X and D1X are (1, 0), the monochromatic image signal m becomes "1" when display controlling the pixels 1 and 4. Therefore, in this case, the pixels 1 and 4 are turned on. Next, when the color pixel data D0X and D1X are (0, 1), the monochromatic image signal M becomes "1" when display controlling the pixels 1 and 3, so that the pixels 1 and 3 are turned on. Next, when the color pixel data D0X and D1X are (1, 1), the monochromatic picture signal M becomes "1" when display controlling any one of the pixels 1 to 4, so that the pixels 1 to 4 are turned on.

As described hereinabove, the pattern generating circuit 8 converts the 4-color information possessed by the color pixel data into four different display patterns on the display surface of the monochromatic display panel. Hence, as in the case of FIG. 1, picture recognition similar to color display may be feasible even on the monochromatic display surface.

Meanwhile, in a personal computer or the like, it becomes occasionally desirable that a plurality of picture surfaces be displayed in superposition on one another. A system in which a plurality of monochromatic picture surfaces generated by the image data processing device shown in FIGS. 1 or 2 are displayed in superposition on one another is hereinafter explained. Meanwhile, the system of FIGS. 7 and 8, explained hereinbelow, is not a conventional system, but a system which may possibly be surmised from the picture data processing device shown in FIGS. 1 or 2.

FIG. 7 is a block diagram showing a system for displaying a plurality of picture surfaces generated by the picture data processing device shown in FIG. 1 in superposition on one another. In the system shown in FIG. 7, two kinds of monochromatic picture signals M1 and M2, generated by two sets of display control blocks B1 and B2 are combined, or synthesized by an OR gate 9 so as to be supplied to a monochromatic display panel 2 similarly to the system shown in FIG. 1. Each display control block includes a refresh memory 1, address generating circuit 3, video circuit 6 and a frame thinning-out circuit 7. Meanwhile, the display timing generating circuit 4 and the synchronizing signal generating circuit 5 are provided in common to the respective display control blocks.

FIG. 8 is a block diagram showing a system for displaying a plurality of monochromatic image pictures generated by the picture data processing device shown in FIG. 2 in superposition on one another. In the system of FIG. 8, monochromatic picture signals M1 and M2 generated by display control block B1' and B2' are synthesized by an OR gate 9, similar to the system of FIG. 7, before being applied to the monochromatic display panel 2.

Meanwhile, when a plurality of monochromatic picture signals are to be synthesized, as in the system shown in FIGS. 7 or 8, it is frequently desired that a given monochromatic picture signal be synthesized with a higher degree of display preference than the other monochromatic picture signal. As an example, it may be desired to display a monochromatic picture surface consisting of letters or characters on another monochromatic picture surface serving as a background.

The following describes a monochromatic picture surface displayed on the monochromatic display panel 2 for the case in which, in a system of FIG. 7, the monochromatic picture signal generated by the first display control B1 is assumed to have a degree of display preference higher than that of the monochromatic picture signal generated by the second display control block B2. When assumed that the color pixel data D01 and D11 in the first display control block B1 of a given pixel are 0, 1, and the color pixel data D02 and D12 of the second display control block B2 of the same pixel are 1, 0, the output M1 in the frame thinning-out circuit 7 in the first display control block B1 becomes "1" during the first frame period in FIG. 4 and becomes "0" during the second and third frame periods. On the other hand, the output M2 of the frame thinning-out circuit 7 in the second control block 2 becomes "1" during the first and second frame periods in FIG. 4 and becomes "0" during the third frame period. Hence, the output of the OR gate 9, that is, the monochromatic picture signal M becomes "1" during the first and second frame periods and "0" during the third frame period, such that the display picture surface of the monochromatic display panel 2 is turned on during the first and the second frame periods, and turned off during the third frame periods. Thus, because of the logic OR functioning of the synthesizing element, no preference is shown for either signal M1 or M2. Instead, the turning-on of the display surface during the second frame period is made in such a manner that the pixel information of the second display control block B2 having the lower degree of display preference is displayed. Thus a problem is presented that a display picture surface of the second display control block B2, having the lower degree of display preference, may be seen on the display picture surface of the first display control group B1 having the higher degree of display preference in a floating fashion.

The same problem occurs similarly in the system shown in FIG. 8.

SUMMARY OF THE INVENTION

The present invention has been made for overcoming the aforementioned problems. It is an object of the present invention to provide a picture data processing device having a plurality of display control blocks for converting color display into monochromatic display, wherein signals synthesis is made in such a manner that the display picture surface having the lower display preference is not seen on the display picture surface having the higher degree of display preference.

The picture data processing device according to the present invention includes a plurality of sets of converting means for converting color pixel data constituted by plural bits of color code data into 1-bit monochromatic picture signal, and synthesizing means for synthesizing a plurality of picture signals outputted from said plurality of sets of converting means with different degrees of preference.

According to the present invention, the plural monochromatic picture signals outputted from the respective converting means are synthesized by synthesizing means with different degrees of preference so that the display picture surface having the lower degree of display preference may not be seen on the display picture surface having the higher degree of display preference.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a circuit diagram showing details of a frame thinning-out circuit 7 shown in FIG. 1.

FIG. 4 is a diagram for explaining the display operation of the frame thinning-out circuit 7 shown in FIGS. 1 and 7.

DESCRIPTION OF THE PREFERRED EMBODIMENTS

Figure 1:
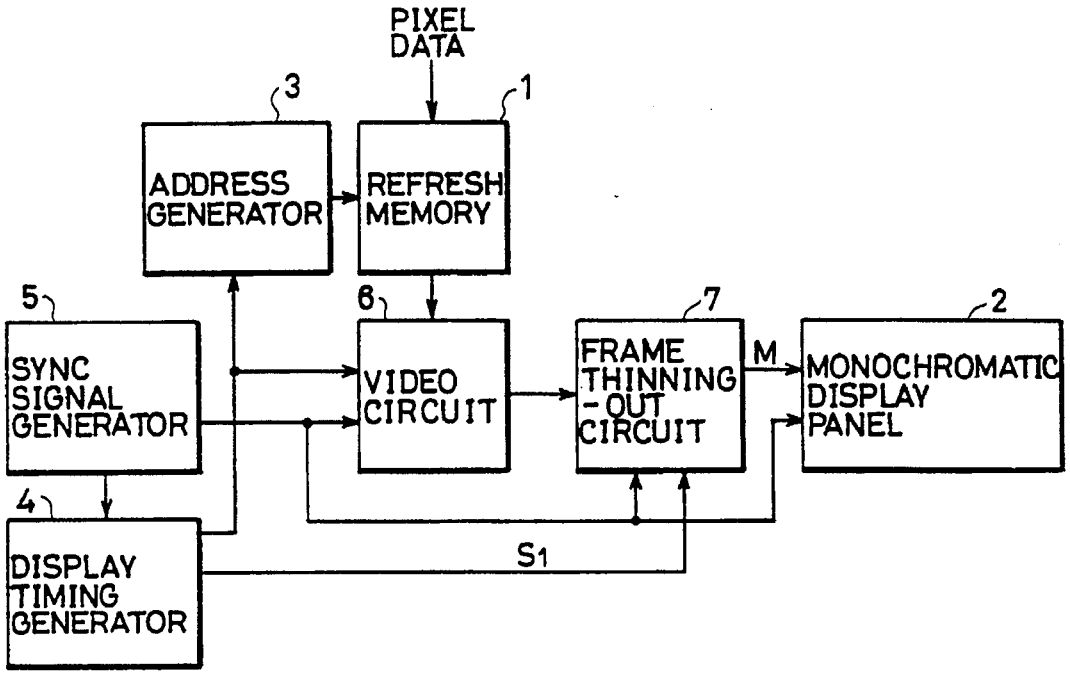
FIG.1 PRIOR ART
FIG. 1 is a block diagram showing an example of a conventional picture data processing device.
Figure 2:
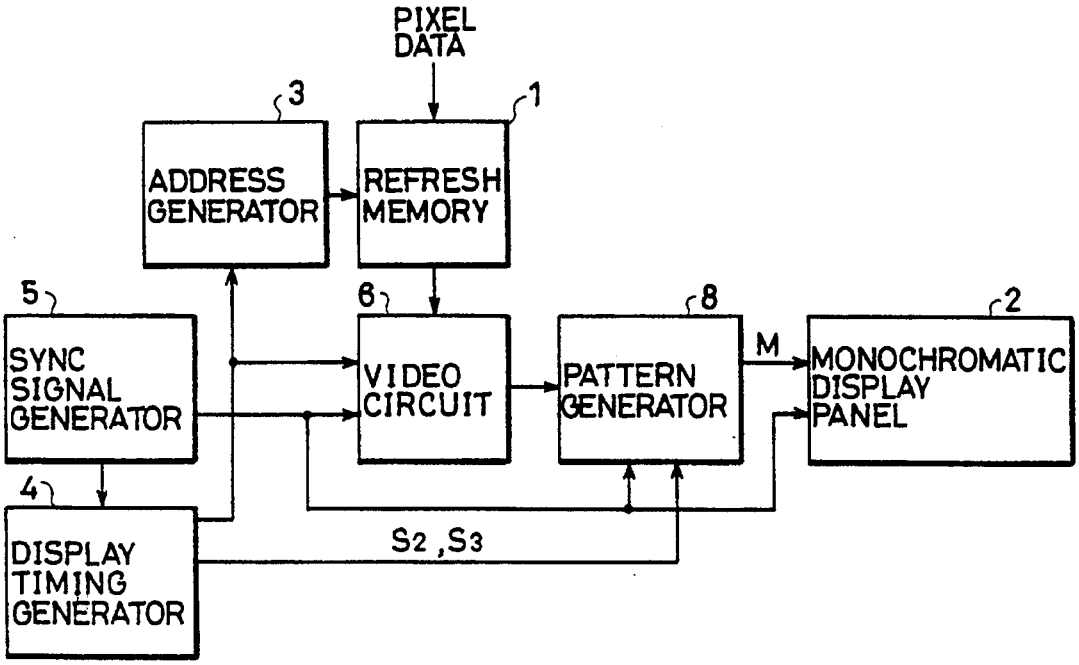
FIG.2 PRIOR ART
FIG. 2 is a block diagram showing another example of the conventional picture data processing device.
Figures 5, 6:
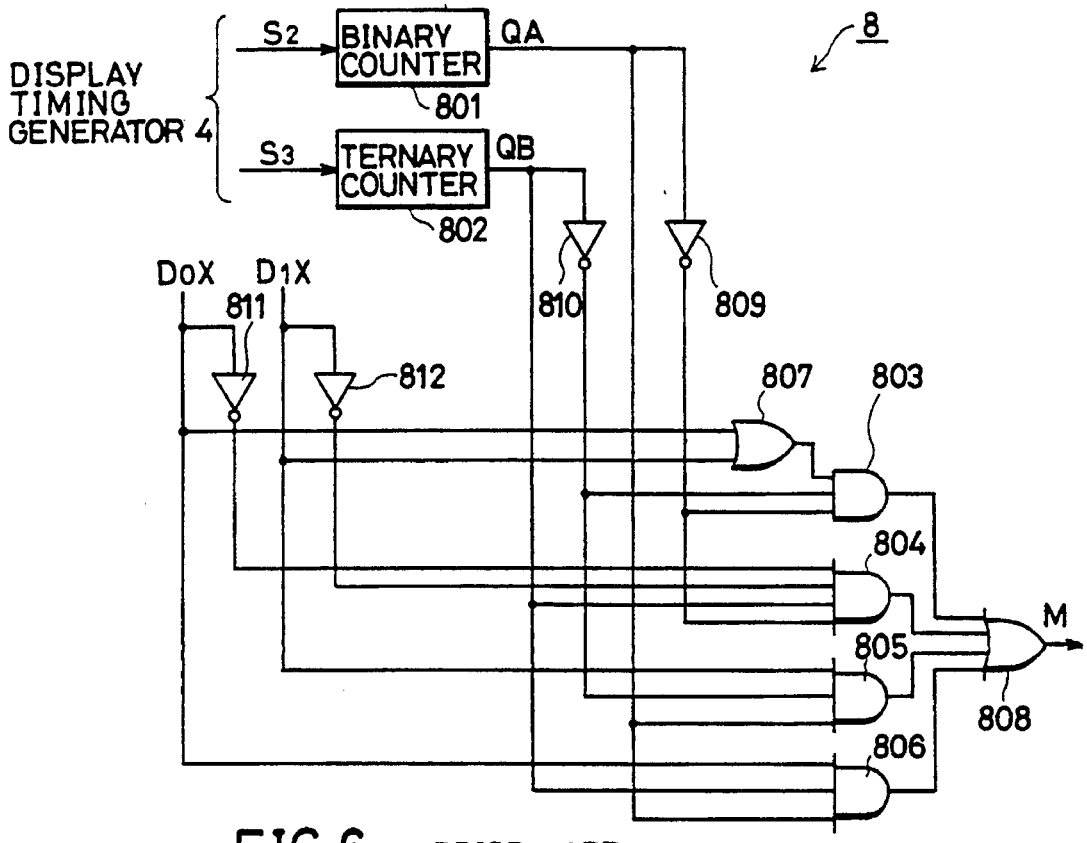
FIG.5 PRIOR ART
FIG.6 PRIOR ART
FIG. 5 is a circuit diagram showing details of a pattern generating circuit 8 shown in FIG. 2.
FIG. 6 is a diagram for explaining the display operation of the pattern generating circuit 8 shown in FIGS. 2 and 5.
Figure 7:
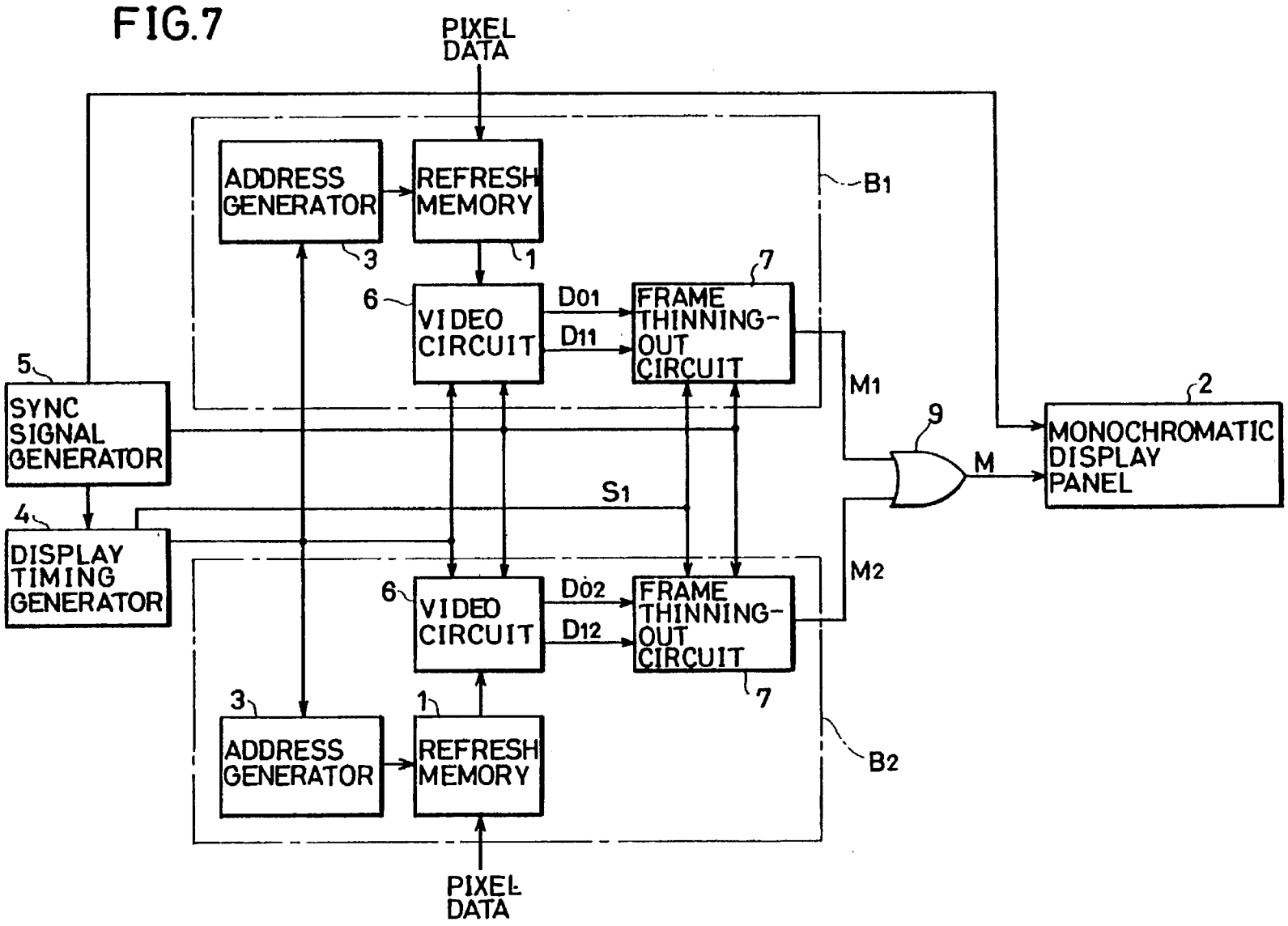
FIG. 7 is a block diagram showing a system for synthesizing a monochromatic picture surface by using a plurality of picture data processing devices shown in FIG. 1.
Figure 9:
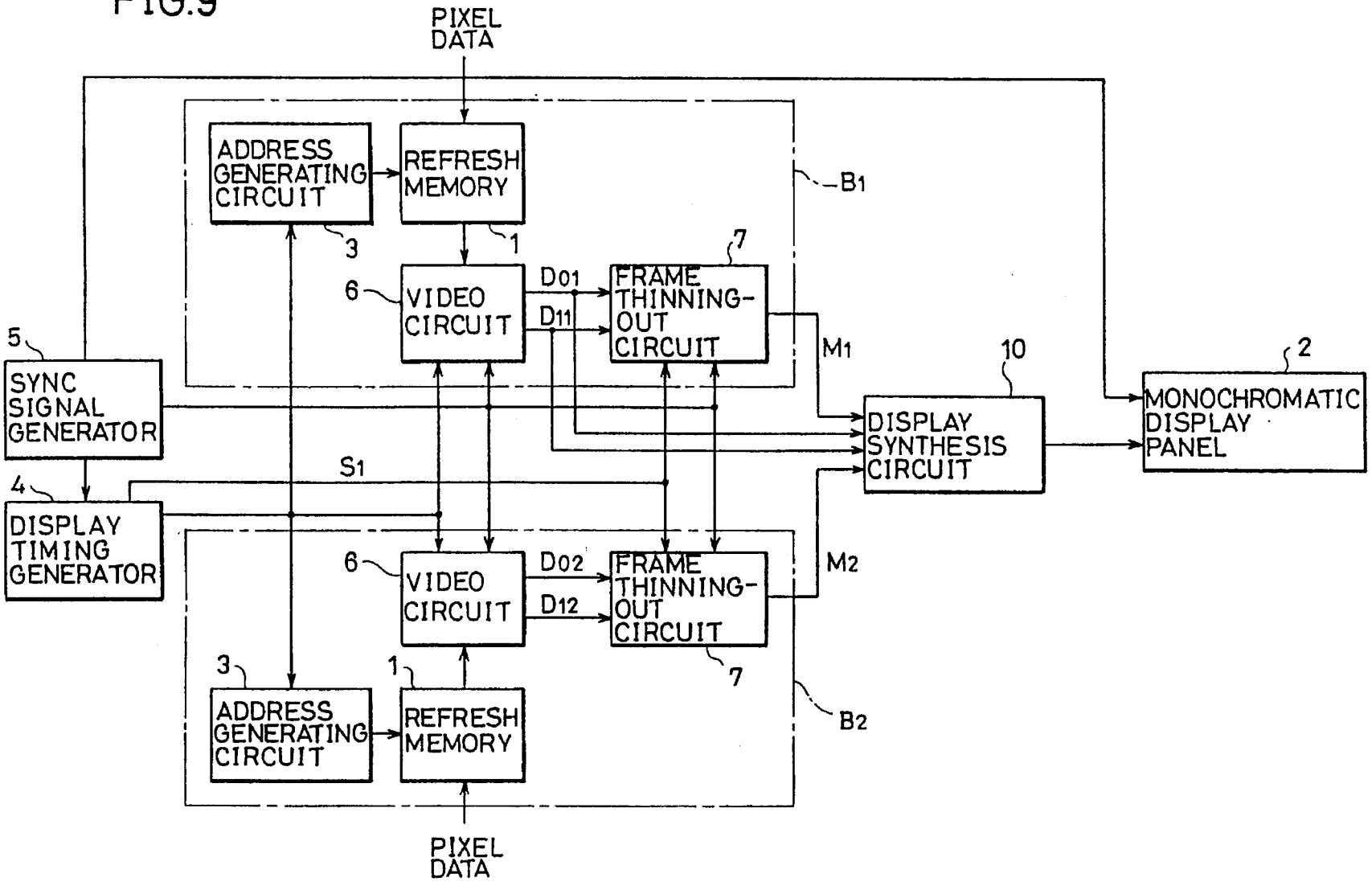
FIG. 9 is a block diagram showing an embodiment of the present invention.

FIG. 9 is a block diagram showing an embodiment of the present invention. In this figure, a display synthesizing circuit 10 is used in the present embodiment in place of the OR gate 9 in the conventional device shown in FIG. 7. The present device is otherwise similar to the conventional device shown in FIG. 7.

Figure 10:
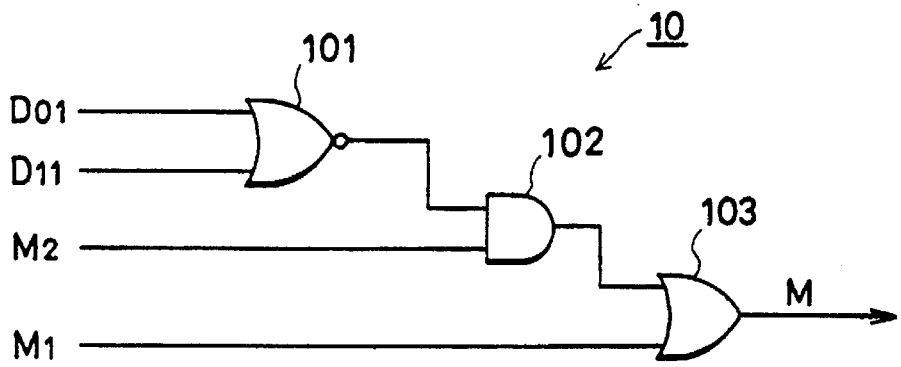
FIG. 10 is a circuit diagram showing details of the display synthesizing circuit 10 shown in FIG. 9.

FIG. 10 is a circuit diagram showing details of the display synthesizing circuit 10 shown in FIG. 9. In FIG. 10, outputs D01 and D11 of a video circuit 6 in the first display control block B1 are supplied to an NOR gate 101. The output of this OR gate 101 is supplied to one input of an AND gate 102. The second monochromatic picture signal M2, generated by the second display control block B2, is transmitted to the the other input of the AND gate 102. The output of the AND gate 102 is transmitted to one input of an OR gate 103. The first monochromatic picture signal M1, generated by the first display control block B1, is transmitted to the other input of the OR gate 103. The synthesized monochromatic picture signal M is outputted via this OR gate 103.

The operation of the embodiment shown in FIGS. 9 and 10 is now explained. When at least one of the color pixel data output D01, D11 of the video circuit 6 in the display control block B1 shown in FIG. 9 is "1", the output of the NOR gate 101 is "0", such that the output of the AND gate 102 is always "0" irrespective of the value of the second monochromatic picture signal M2 generated by the second display control block B2. Hence, the output of the AND gate 103, that is, the monochromatic picture signal M, coincides with the first monochromatic picture signal M1 generated by the first display control block B1. That is, when there is a color pixel data outputted from the video circuit 6 in the first display control block B1, that is, when at least one of D01 and D11 is "1", the output of the second display control block B2, that is, the second monochromatic picture signal M2, is suppressed completely, so that there is no such situation in which the pixel surface of the display control block B2, which should not be seen, may be seen actually. In other words, the picture surface of the second display control block B2 is displayed on the monochromatic display panel 2 only when there are no color pixel data outputs D01, D11 of the video circuit 6 in the first display control block B1, that is, when D01 and D11 are both "0".

Figure 8:
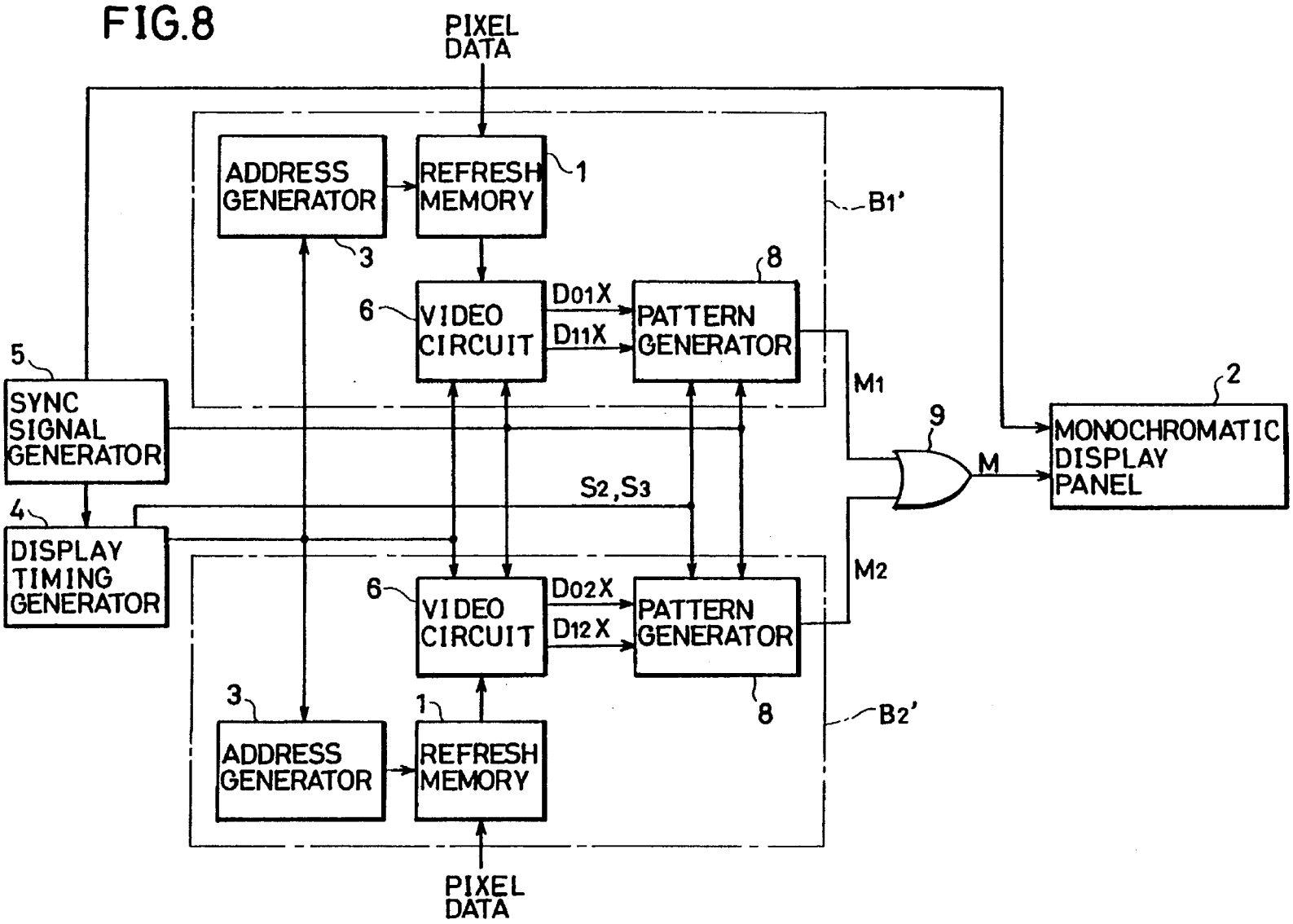
FIG. 8 is a block diagram showing a system for synthesizing a monochromatic picture surface by using a plurality of picture data processing devices shown in FIG. 2.
Figure 11:
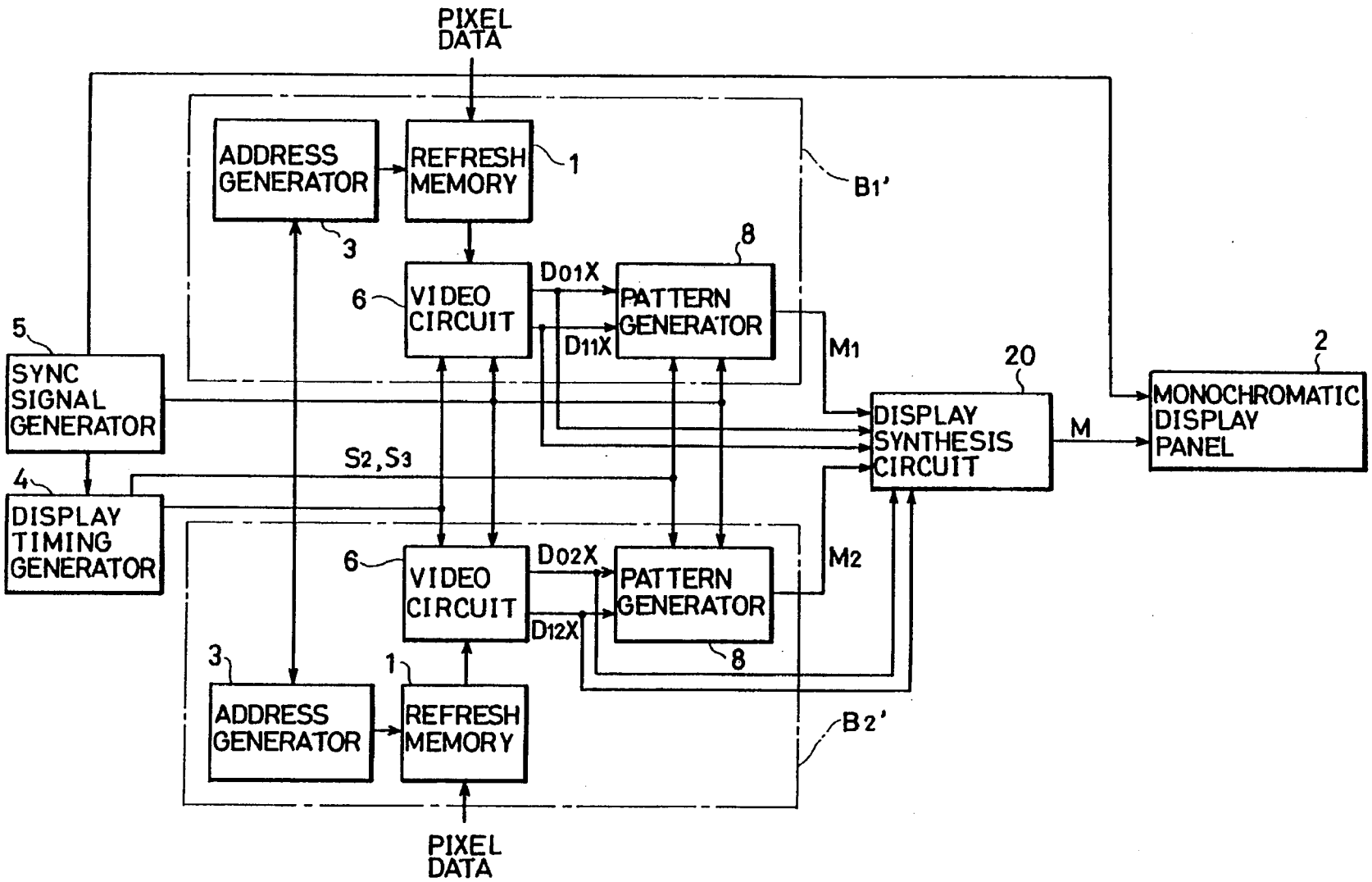
FIG. 11 is a block diagram showing another embodiment of the present invention.

FIG. 11 is a block diagram showing another embodiment of the present invention. The present embodiment is similar to the conventional device shown in FIG. 8 except that a display synthesizing circuit 20 is provided in place of the OR gate 9 in the conventional device shown in FIG. 8.

Figure 12:
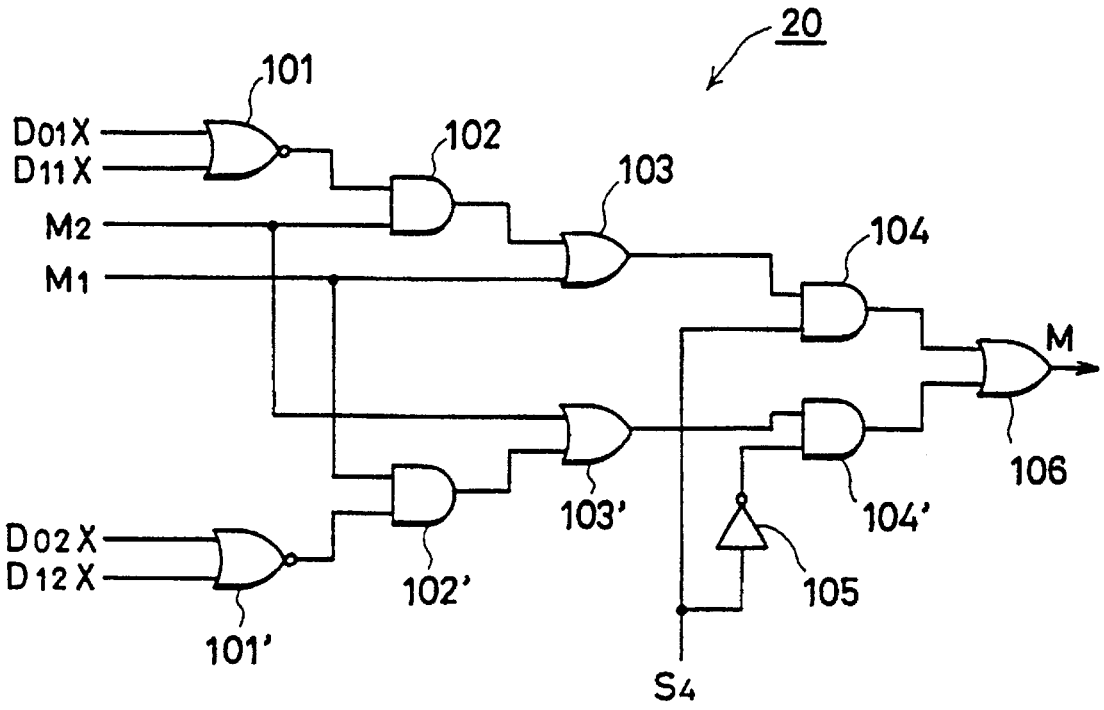
FIG. 12 is a circuit diagram showing details of the display synthesizing circuit 20 shown in FIG. 11.

FIG. 12 is a circuit diagram showing details of the display synthesizing circuit 20 shown in FIG. 11. In the display synthesizing circuit 10 employed in the embodiment of FIGS. 9 and 10, the degree of display preference is fixedly set so that the first display control block B1 has a degree of display preference higher than that of the second display control block B2. However, the degree of display preference need not be set fixedly. The display synthesizing circuit 20 shown in FIG. 12 is so designed that the display preference can be switched as desired. Thus a NOR gate 101, AND gate 102 and an OR gate 103 are provided for the case of preferential display by the first display control block B1. Similarly, a NOR gate 101', AND gate 102' and an OR gate 103' are provided for the case of preferential display of the picture surface by the second display control block B2. The AND gates 104 and 104' are controlled so as to be complementarily opened and closed by a display preference degree switching signal S4 and an inverted signal S4 thereof inverted by the inverter 105, so as to select one of the outputs of the OR gates 103 and 103' to transmit the selected output to the OR gate 106. Thus, when the AND gate 104 is opened and the AND gate 104' is closed, the monochromatic picture signal M, in which the picture surface by the display control block B1 is preferred, is outputted at the OR gate 106. On the other hand, when the AND gate 104' is opened and the AND gate 104 is closed, the monochromatic picture signal M, in which the picture surface by the second display control block B2 is preferred, is outputted via the OR gate 106. Therefore, by switching the display preference degree switching signal S4, picture surface preference may be switched between the picture surface by the first display control block B1 and that by the second display control block B2.

Although the foregoing example provides for display of a preferred one of two superimposed picture surfaces generated by the two display control blocks, the invention is clearly applicable to providing a display of a preferred one of several superimposed picture surfaces generated by three or more display control blocks.

It is also possible to employ the display synthesizing circuit 20 in the embodiment of FIG. 9 and the display synthesizing circuit 10 in the embodiment of FIG. 11.

Although the color pixel data to be processed are 2-bit data in the above embodiment, it is also possible to process color pixel data formed by three or more bits. In this case, the number of bits and the number of logic circuits of the counter employed in the pattern generating circuit 8 and the frame thinning-out circuit 7 need be expanded correspondingly.

Although the monochromatic display system is employed in the above embodiment, it may also be adapted to a color display system. That is, when the number of bits of the pixel data stored in the picture memory is M, M being an integer and the number of colors that may be displayed in the display system is 2N, N being an integer lesser than M, the (M–N) bit color data may be processed by the above described frame thinning-out circuit or the pattern generating circuit to convert the color into the display concentration or display pattern for expanding the number of colors that may be displayed on the display system. Similar effects may be obtained by the application of the present invention when a number of picture surfaces are superimposed one on another as described hereinabove.

According to the present invention, as described hereinabove, in synthesizing a plurality of monochromatic picture signals converted from the color pixel data, each monochromatic picture surface may be synthesized so that there is no such situation in which the monochromatic picture surface having a lower degree of display preference is displayed on another monochromatic picture surface having a higher degree of display preference.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A picture data processing device for processing picture data for display driving a display unit having $2^n$ display colors where n is an integer, comprising a plurality of sets of converting means each operating for converting m-bit color picture data into an n-bit color picture signal, where m is an integer greater than n, synthesizing means for selectively outputting only one of a plurality of picture signals, received from said plurality of sets of converting means, in accordance with a preference signal exclusive of said picture signals and representing different degrees of preference for the picture signals, and means for providing said preference signal to said synthesizing means for selecting only one of said plurality of picture signals for output thereby, wherein said synthesizing means comprises a plurality of logic means, each of said logic means responsive to presence of corresponding m-bit color picture data, converted by a corresponding one of said converting means to a respectively corresponding one of said plurality of n-bit color picture signals, for suppressing display of a non-corresponding one of said plurality of n-bit color picture signals converted by a non-corresponding converting means, and switching means for selecting a preferred one of said converted n-bit color picture signals as said only one picture signal to be outputted by said synthesizing means, said switching means comprising preference means responsive to said preference signal for changing degrees of preference associated with said plurality of n-bit color picture signals, thereby switchably changing the n-bit color picture signal selected as said only one picture signal to be outputted by said synthesizing means.

2. The picture data processing device according to claim 1, wherein said display unit is a monochromatic display unit, said plurality of converting means converting color pixel data constituted by plural bit color code data into 1-bit monochromatic picture signals, and wherein said plurality of sets of converting means output plural monochromatic picture signals to said synthesizing means.

3. The picture data processing device according to claim 2, wherein said converting means includes memory means for storing said color pixel data in an amount corresponding at least to one picture surface of said monochromatic display unit, read-out means for reading out color pixel data from said memory means, means for processing said color pixel data read out from said read-out means for conversion thereof into color picture signals, and monochromatic picture signal generating means for processing said color picture signals and generating said 1-bit monochromatic picture signals expressing color information possessed by the color picture data for each pixel in a display form different from a color display form.

4. The picture data processing device according to claim 3, wherein said monochromatic picture signal generating means includes a first logic circuit having a predetermined number of output states, said output states being changed for each frame, a second logic circuit for controlling turning-on and turning-off of each pixel for each frame period at a turning-on ratio corresponding to said color information and on the basis of the output of said first logic circuit and the color information possessed by said color picture data for each pixel.

5. The picture data processing device according to claim 3, said color picture data having each pixel thereof corresponding to a rectangular region consisting of N horizontal dots and M vertical dots on said monochromatic display unit, M and N being integers not less than 1, said monochromatic picture signal generating means including means responsive to color information possessed by said color picture data for each pixel to control turning-on and turning-off of each dot in the corresponding rectangular region.

6. The picture data processing device according to claim 1, wherein said n-bit color picture signals comprise monochromatic picture signals, and said logic means comprises detection means for detecting the presence or non-presence of corresponding m-bit color picture data to be written by monochromatic picture signals from said corresponding one of said plurality of sets of converting means and suppressing means responsive to the detection by said detection means of the presence of said color picture data to suppress monochromatic picture signals from the other converting means, non-corresponding thereto.

7. The picture data processing device according to claim 6, comprising a plurality of respectively corresponding sets of each of said detection means and said suppressing means, different ones of said detection means detecting the presence or non-presence of monochromatic picture signals from converting means respectively corresponding thereto, and wherein each said suppressing means is responsive to a detection output from the corresponding detection means to control the suppression of the monochromatic picture signals from converting means non-corresponding thereto.

8. The picture data processing device according to claim 1, wherein said each of said logic means comprises:

first logic means receiving at inputs thereof signals representative of said corresponding m-bit color picture data and second logic means receiving at inputs thereof at least first and second converted n-bit picture signals and an output of said first logic means for suppressing at least one of said converted n-bit picture signals and transmitting at least one of said converted n-bit picture signals in accordance with the output of said first logic means.

9. The picture data processing device according to claim 1, wherein said plurality of logic means comprises:

first logic means receiving at inputs thereof first m-bit color picture data signals provided to one of said converting means for conversion to one of said n-bit color picture signals and second logic means receiving at inputs thereof at least said one of said n-bit color picture signals and another of said n-bit color picture signals converted from said color picture data signals and an output of said first logic means, for suppressing at least said another of said converted n-bit color picture signals and transmitting said one of said converted n-bit color picture signals in accordance with the output of said first logic means.

10. The picture data processing device according to claim 9, wherein said first logic means comprises a first logic gate receiving said first m-bit color picture data signals, and said second logic means comprises a second gate receiving an output from said first logic gate and said another of said n-bit color picture signals and a third logic gate receiving an output from said second logic gate and said one of said n-bit color picture signals for outputting said another of said n-bit color picture signals only when said first m-bit color picture data signals have a value indicative of a predetermined value of said one of said n-bit color picture signals.

11. The picture data processing device according to claim 1, wherein said synthesizing means comprises:

first logic means receiving at inputs thereof m-bit color picture data signals provided to said converting means for conversion to said n-bit color picture signals and second logic means receiving at inputs thereof at least two of said n-bit color picture signals converted from said m-bit color picture data signals and an output of said first logic means, for suppressing at least one of said converted n-bit color picture signals and transmitting another of said converted n-bit color picture signals in accordance with the output of said first logic means.

12. A picture data processing system for processing picture data for display on a display unit having C display colors, where C is an integer according to C=2 exp (n) and where n is a non zero integer, comprising:

a plurality of sets of converting means, each set operating for converting m-bit color picture data into an n-bit color picture signal, where m is an integer greater than n, and suppressing means for selectively suppressing at least one of a plurality of said n-bit color picture signals received from said plurality of sets of converting means responsive to said m-bit color picture data in accordance with different degrees of preference for the picture signals, said suppressing means comprising a plurality of logic means, each of said logic means responsive to presence of m-bit color picture data, converted by a corresponding one of said converting means to a respectively corresponding one of said plurality of n-bit color picture signals, for suppressing display of a non-corresponding one of said plurality of n-bit color picture signals converted by a non-corresponding converting means, and switching means for selecting at least one n-bit color picture signal among the plurality of n-bit color picture signals for suppression from display, said switching means comprising preference changing means for switchably changing preference values associated with each of said n-bit color picture signals, thereby switchably changing the at least one n-bit color picture signal selected for suppression from display.

13. A picture data processing device in accordance with claim 12, further comprising means for providing a preference signal to said suppressing means for providing said preference value to select said at least one of said plurality of n-bit color picture signals for suppression thereby.

14. A picture data processing system in accordance with claim 13, wherein said switching means operates in accordance with said preference value for selecting logic means from among said plurality of logic means, said switching means comprising preference changing means responsive to said preference signal for switchably changing preferences associated with said logic means, thereby switchably changing the at least one n-bit color picture signal selected for suppression from display.

15. A picture data processing system as recited in claim 12, wherein n is an integer greater than 1, for processing picture data for display on a display unit having at least four display colors, wherein said each set of converting means comprises means for converting m-bit color picture data into at least a 2-bit color picture signal.

16. In a picture data processing system including a plurality of sets of converting means, each set operating for converting m-bit color picture data into an n-bit color picture signal, where n is a non-zero integer and m is an integer greater than n, a method of processing picture data for display on a display unit capable of displaying C display colors, where C is an integer according to C=2 exp (n), comprising the steps of:

receiving a plurality of n-bit color picture signals outputted respectively from said plurality of sets of converting means; and selectively suppressing at least one of said plurality of n-bit color picture signals in accordance with said m-bit color picture data depending on different degrees of preference for the picture signals, said step of selectively suppressing comprising the steps of:

responding to a preference signal having a particular preference value for selecting a particular one of said m-bit color picture data, converted by a particular one of said sets of converting means to a respectively corresponding n-bit color picture signal, responding to presence of said particular one of said m-bit color picture data for suppressing display of non-corresponding n-bit color picture signals from non-corresponding converting means, and responding to a different preference value of said preference signal by selecting a different one of said m-bit color picture data, converted to a different corresponding n-bit color picture signal, thereby changing the n-bit color picture signals to be suppressed from display.

17. A method as recited in claim 16, wherein n is an integer greater than 1, said method comprising processing picture data for display on a display unit capable of displaying at least four display colors.

* * * * *